US006024684A

United States Patent [19]

Mayländer et al.

[11] Patent Number: 6,024,684

[45] Date of Patent: Feb. 15, 2000

[54] DEVICE FOR PRODUCING FOLDED ITEMS

[75] Inventors: Edgar Mayländer, Estenfeld; Horst Bernhard Michalik, Höchberg, both of Germany

[73] Assignee: Koenig & Bauer Aktiengesellschaft, Wurzburg, Germany

[21] Appl. No.: 09/068,108

[22] PCT Filed: Nov. 7, 1996

[86] PCT No.: PCT/DE96/02126

§ 371 Date: May 5, 1998

§ 102(e) Date: May 5, 1998

[87] PCT Pub. No.: WO97/17200

PCT Pub. Date: May 15, 1997

[30] Foreign Application Priority Data

Nov. 8, 1995 [DE] Germany ..... 195 41 538

[51] Int. Cl.[7] ..... B31B 49/00

[52] U.S. Cl. ..... 493/346; 493/358; 493/440; 493/479; 270/41

[58] Field of Search ..... 493/357, 356, 493/358, 359, 360, 439, 440, 476, 479, 346; 270/5.01, 6–9, 41

[56] References Cited

U.S. PATENT DOCUMENTS

| | | | |
|---|---|---|---|
| 3,191,926 | 6/1965 | Ramaika . | |
| 4,779,859 | 10/1988 | Knauer . | |
| 5,303,909 | 4/1994 | Maylander . | |
| 5,328,437 | 7/1994 | Maylander et al. | 493/440 |
| 5,503,379 | 4/1996 | Michalik et al. . | |
| 5,605,267 | 2/1997 | Whitten | 270/41 |

FOREIGN PATENT DOCUMENTS

| | | |
|---|---|---|
| 668877 | 11/1938 | Germany . |
| 724900 | 9/1942 | Germany . |
| 1535985 | 6/1969 | Germany . |
| 3624990 | 5/1989 | Germany . |
| 4128797 | 1/1994 | Germany . |
| 4344362 | 6/1995 | Germany . |
| 57-151565 | 9/1982 | Japan . |

*Primary Examiner*—Eugene L. Kim
*Attorney, Agent, or Firm*—Jones, Tullar & Cooper, P.C.

[57] ABSTRACT

Folded products are produced in a web-fed press by directing the printed web to longitudinal formers and then to multi-width transverse folders. The longitudinal formers are supported so that at least selected ones of them can be shifted vertically with respect to the transverse folders. A parallelogram-like linkage is used to shift the longitudinal formers vertically. Vertical shifting of the formers accomplishes transverse shifting of the location of the delivery of formed products from the formers to the multi-width transverse folders.

5 Claims, 10 Drawing Sheets

DEVICE FOR PRODUCING FOLDED ITEMS

FIELDS OF THE INVENTION

The present invention relates to a device for producing folded products using longitudinal formers in which the longitudinal former is movable vertically.

DESCRIPTION OF THE PRIOR ART

In the course of producing folded products, for example telephone directories, it is known to arrange double-width transverse folding devices in connection with longitudinal formers. A double-width transverse folding device is represented in DE-PS 7 24 900, wherein several stationary longitudinal formers are placed upstream of it.

It is disadvantageous that each of these several stationary longitudinal formers has a separate paper feed and a separate former inlet. If it is intended to vary the thickness, i.e. the number of pages, of the two folded products coming out of the double-width transverse folding device, this is only possible by means of a changed web feed, which requires much space, and angle bars, not represented.

Furthermore, a longitudinal former is known from DE 36 24 990 C2, wherein the inclination of the former can be slightly displaced and tis former can be moved independently of other longitudinal formers in order to feed, in this way, the formed products, generated in the course of the first longitudinal folding process, laterally offset to a transverse folding device. The lateral offset is used as an engagement surface for the subsequent separation of the folded products, for example by means of grippers, and is only suitable for short distances, i.e. for products which only need to be "slightly offset". It is not possible to vary the product thickness of folded products without an increased outlay.

SUMMARY OF THE INVENTION

It is the object of the present invention to create a longitudinal former for a multi-width transverse folding device.

In accordance with the invention, this object is attained by use of a movable longitudinal former. This former is vertically movable by utilization of a parallelogram-like pivot square. This pivot square consists of at least two couplings which are of the same length and which are pivotable parallel with each other.

The advantages which can be achieved by means of the present invention reside in particular in that, even when employing a multi-width transverse folding device, only one longitudinal former feed device, which can be commonly driven, is required. The product thickness as well as the position of the folded products in the multi-width transverse folding device can be respectively varied in the end position by vertical movement of the longitudinal former. The invention is particularly suited for manufacturing folded products for the production of telephone directories. In addition, the structural height of the folding apparatus is kept low.

BRIEF DESCRIPTION OF THE DRAWING

An exemplary embodiment of the present invention is represented in the drawings and will be described in greater detail in what follows.

Shown are in.

DESCRIPTION OF THE PREFERRED EMBODIMENTS

Figure 1:
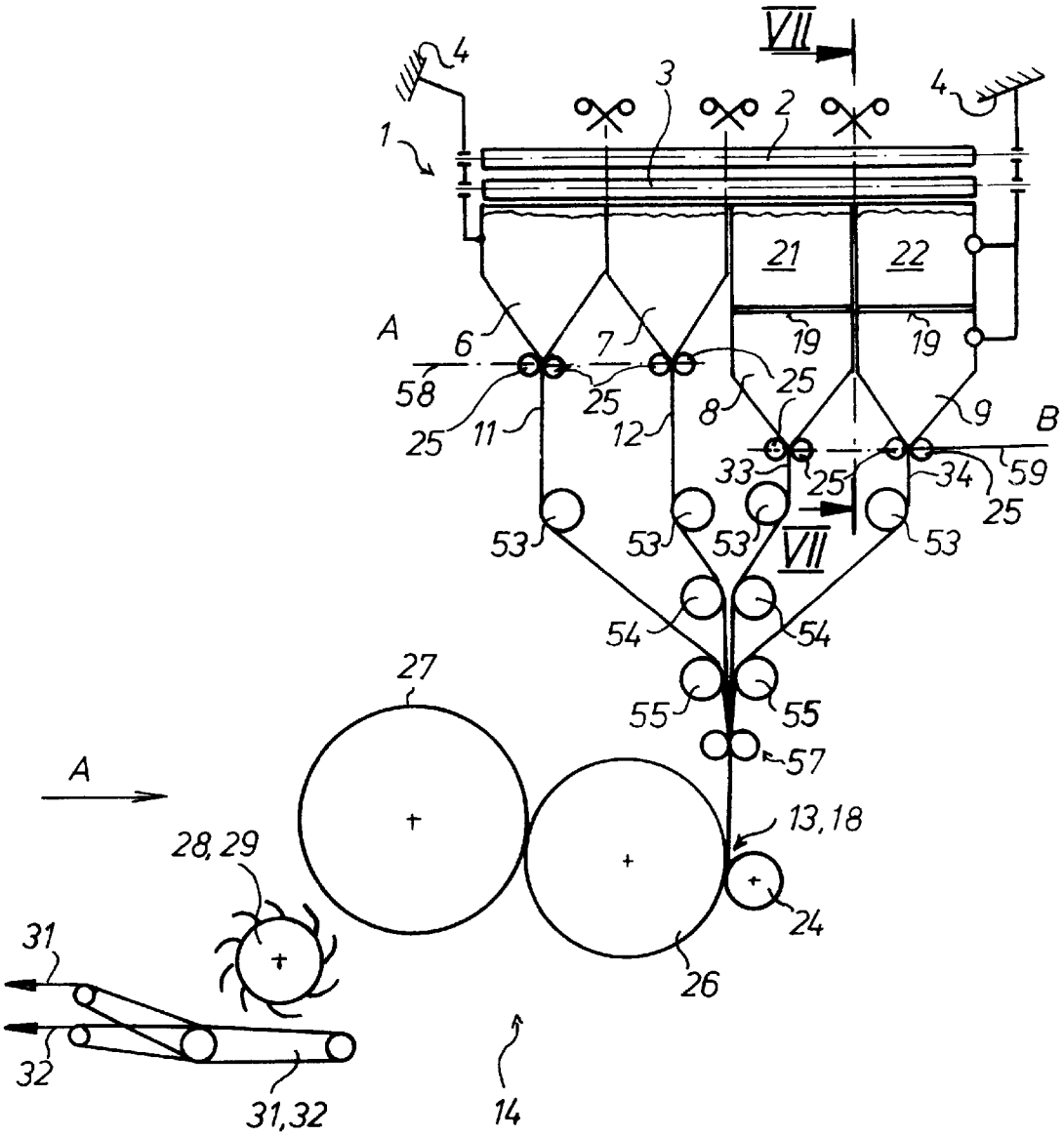
FIG. 1, a schematic elevation view of a double-width transverse folding device with left and right longitudinal formers arranged above it, in accordance with the present invention, wherein the two right longitudinal formers are in a lower position.

Referring initially to FIG. 1, a schematically represented former inlet roller group 1 is arranged in a known paper guide frame 4 containing angle bars, drawing rollers, longitudinal cutting devices, longitudinal register devices and paper guide rollers.

Figure 2:
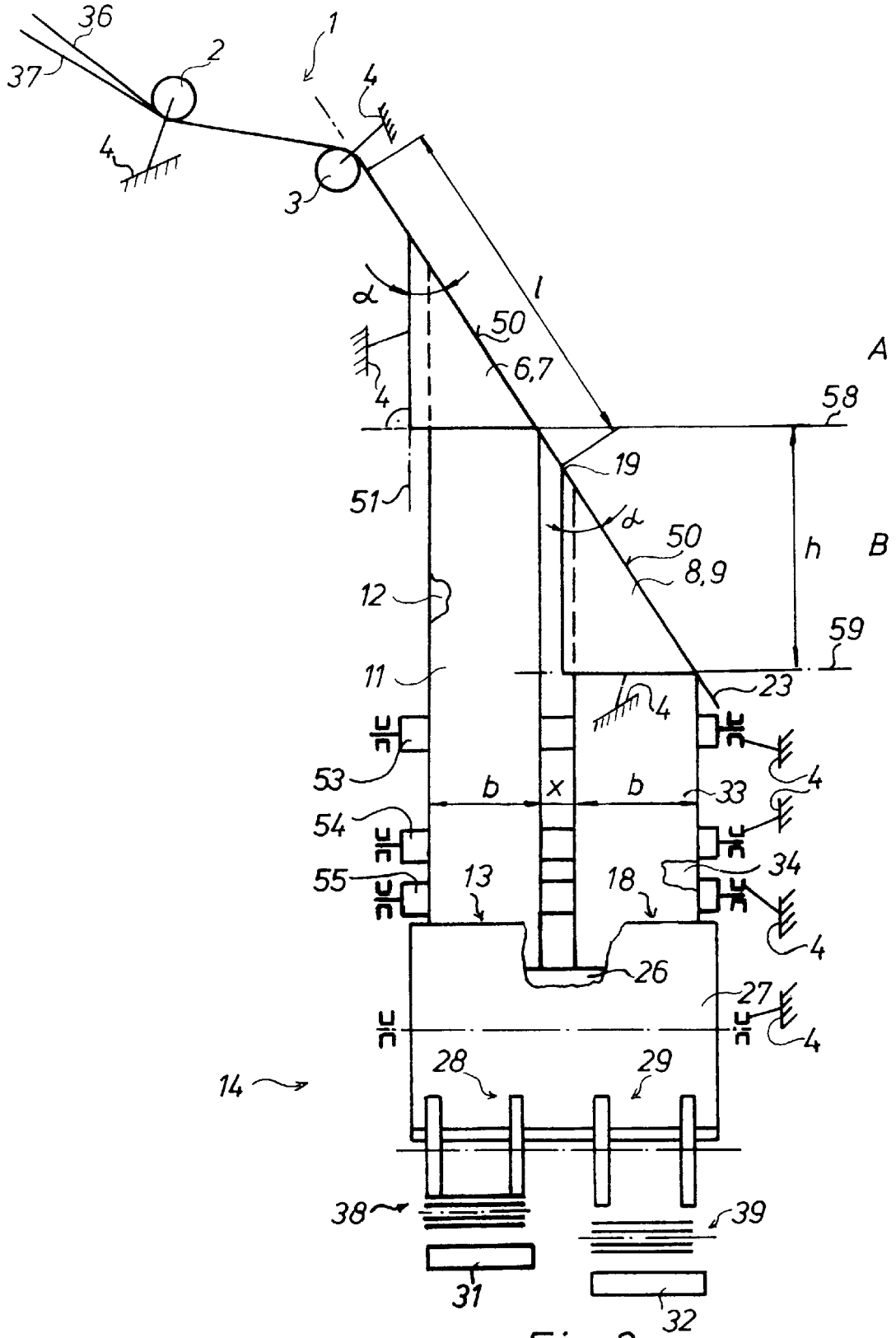
FIG. 2, a view in accordance with FIG. 1 taken in the direction indicated by arrow A in FIG. 1, but with a representation of the paper webs above the longitudinal formers, wherein paper trains enter both inlets of the transverse folding device.
Figure 5:
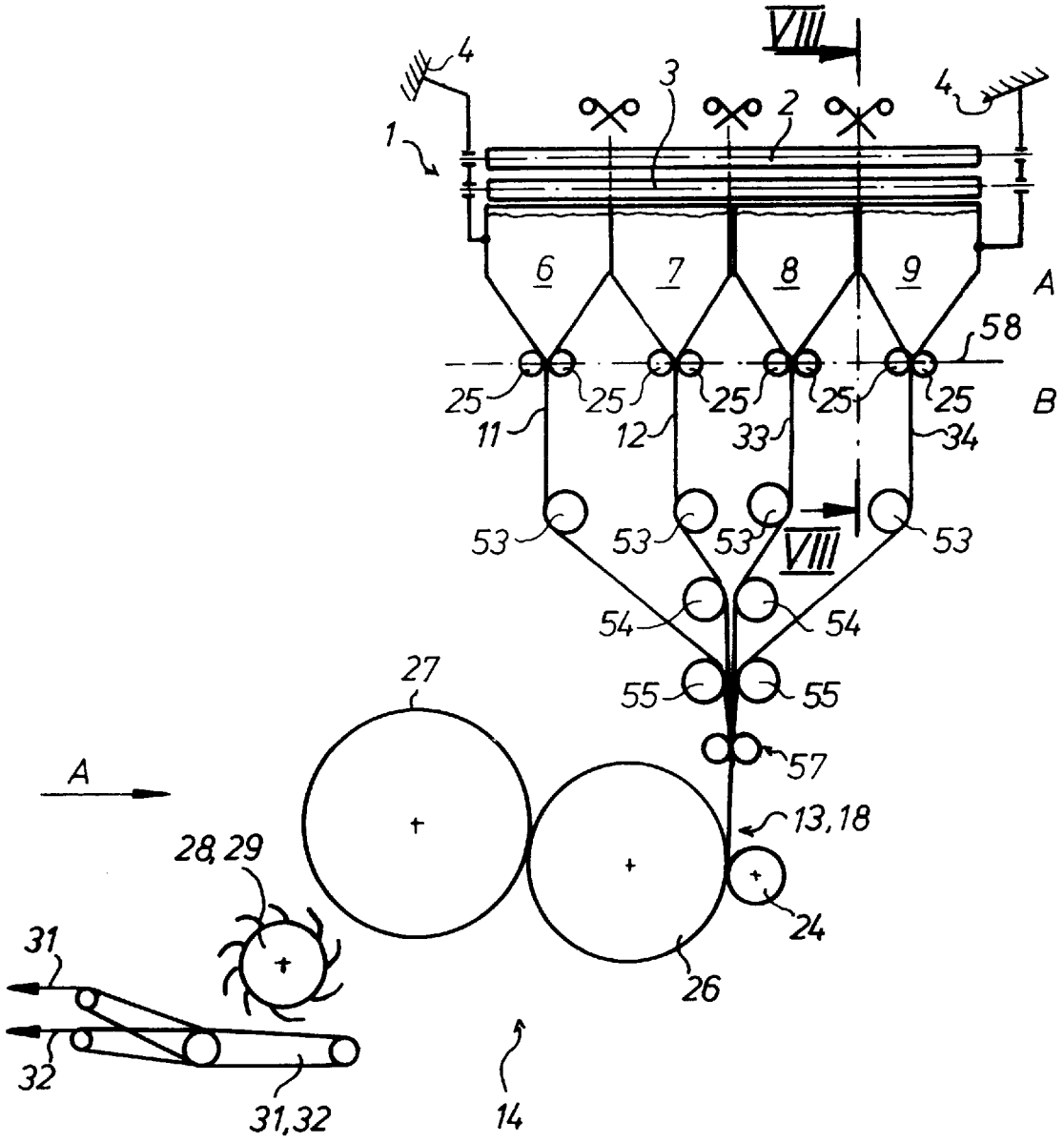
FIG. 5, a schematic view of a double-width transverse folding device with left and right longitudinal formers arranged above it, in accordance with the present invention wherein all left and all right longitudinal formers are arranged in an upper position, and all paper trains enter the first inlet of the transverse folding device.
Figure 6:
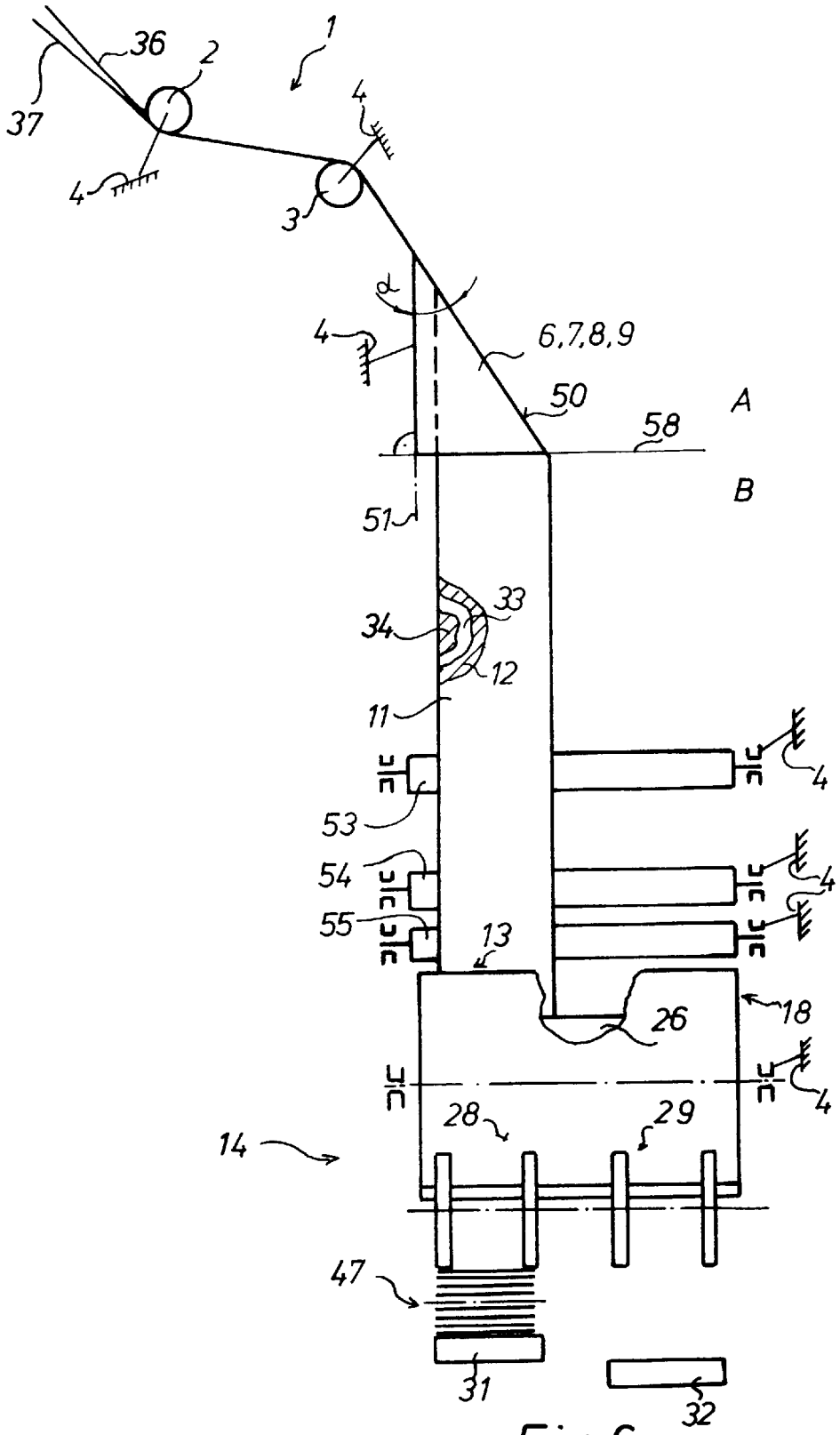
FIG. 6, a view in accordance with FIG. 5, taken in the direction indicated by arrow A, but with a schematic representation of the paper webs above the longitudinal formers.
Figure 7:
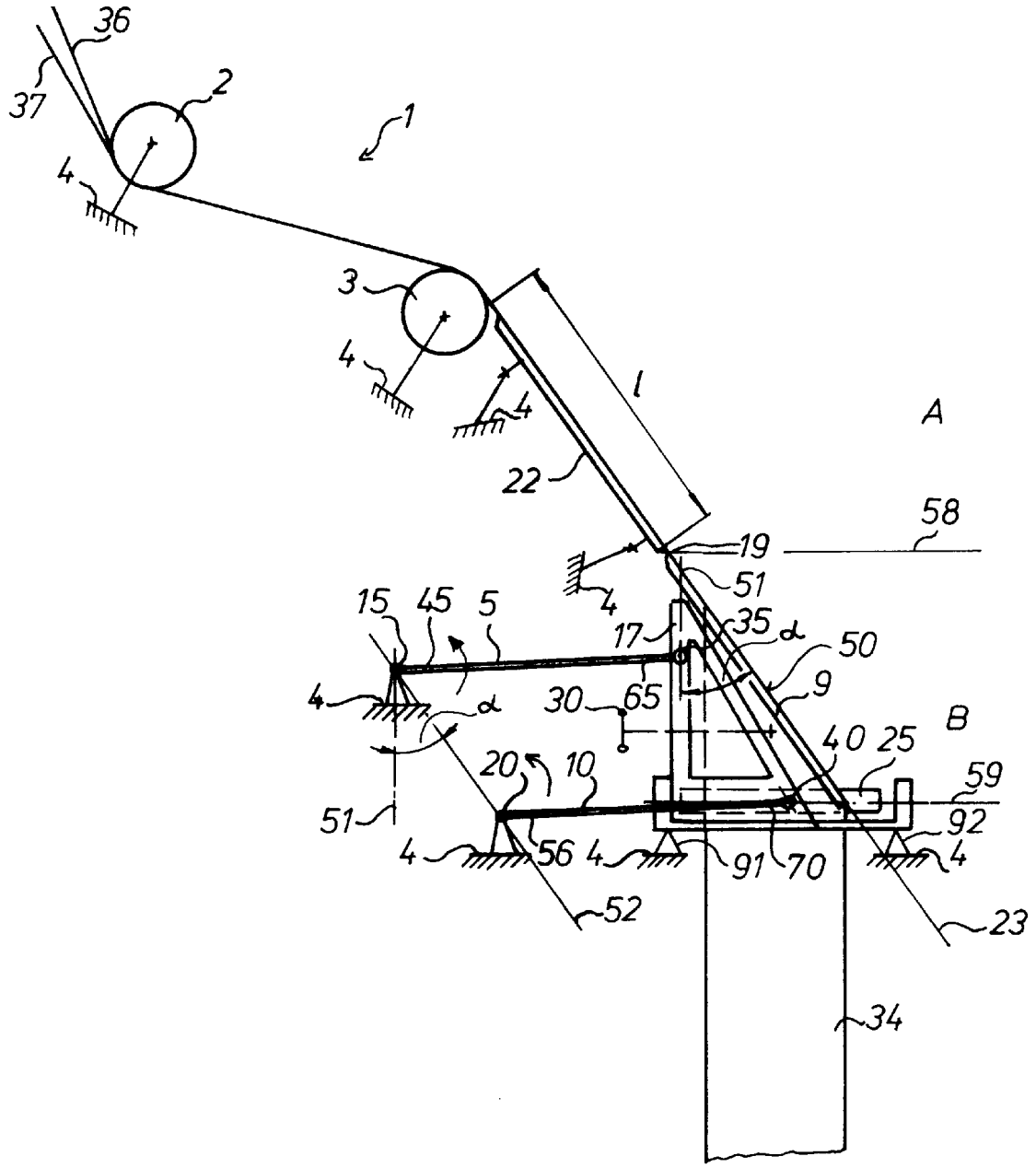
FIG. 7, a section taken along line VII—VII of FIG. 1 through the former inlet roller group and with a right longitudinal former, located underneath it and above a second inlet of the double-width transverse folding device, in a lower position in accordance with FIG. 1.
Figure 8:
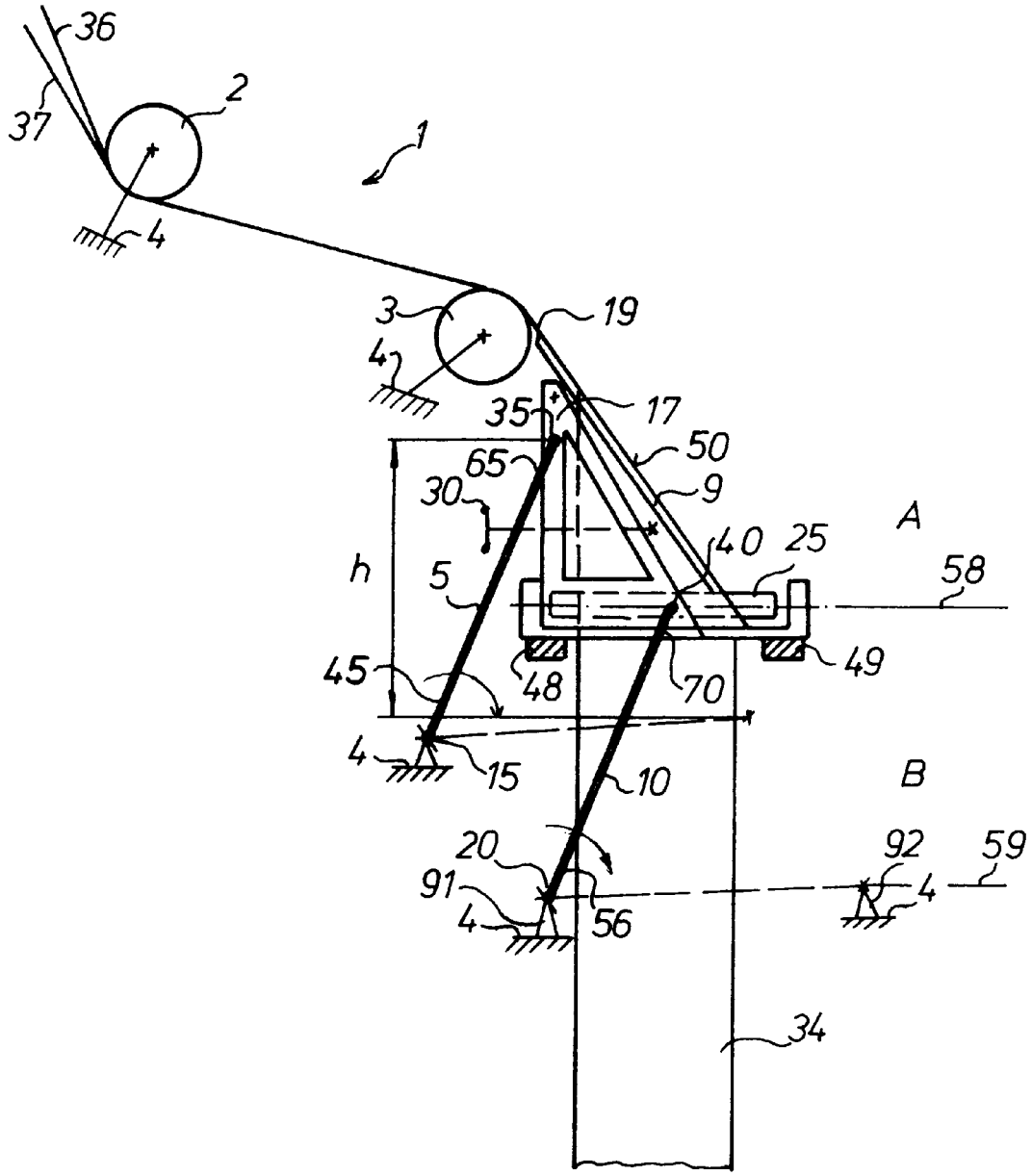
FIG. 8, a section taken along line VIII—VIII of FIG. 5 through the former inlet roller group and with a right longitudinal former, located underneath it and above a first inlet of the double-width transverse folding device, in an upper position in accordance with FIG. 5.

The former inlet roller group 1 consists, for example, of a driven former pre-inlet roller 2 and former inlet rollers 3. Both rollers 2, 3 are respectively seated in the lower part of the paper guide frame 4 and are respectively assigned to left longitudinal formers 6, 7, or respectively right longitudinal formers 8, 9. A left and a left center longitudinal former 6, 7 and a right center and right longitudinal former 8, 9 are represented as depicted in FIGS. 1 and 2. The two left longitudinal formers 6, 7 are fixed disposed in the lower part of the paper guide frame 4 above a left or first inlet 13 of a multi-width, for example double-width transverse folding device 14, so that after leaving the left longitudinal formers 6, 7, the paper trains 11, 12 directly enter the first inlet 13 of the transverse folding device 14. The two right longitudinal formers 8, 9 are respectively each fixedly disposed in a former holder 16, 17, respectively for example a frame as seen in FIGS. 7 and 8, which receives forming rollers 25 also fixed on the frame at the outlet. The left longitudinal former 6, 7 also has forming rollers 25 arranged in pairs at the outlet. Each one of the former holders 16, 17 receives its associated one of the two longitudinal formers 8, 9—it being understood that former holder 16 for the former 8 is not shown—and respectively be interlockingly connected with the paper guide frame 4 in two positions A, as seen in FIGS. 1 and 5, or respectively B as seen in FIGS. 7 and 8: once above a right or second inlet 18 of the transverse folding device 14 (FIGS. 1 and 2, position B) and once above the left or first inlet 13 of the transverse folding device 14 (FIGS. 5 and 6, position A).

Figure 4:
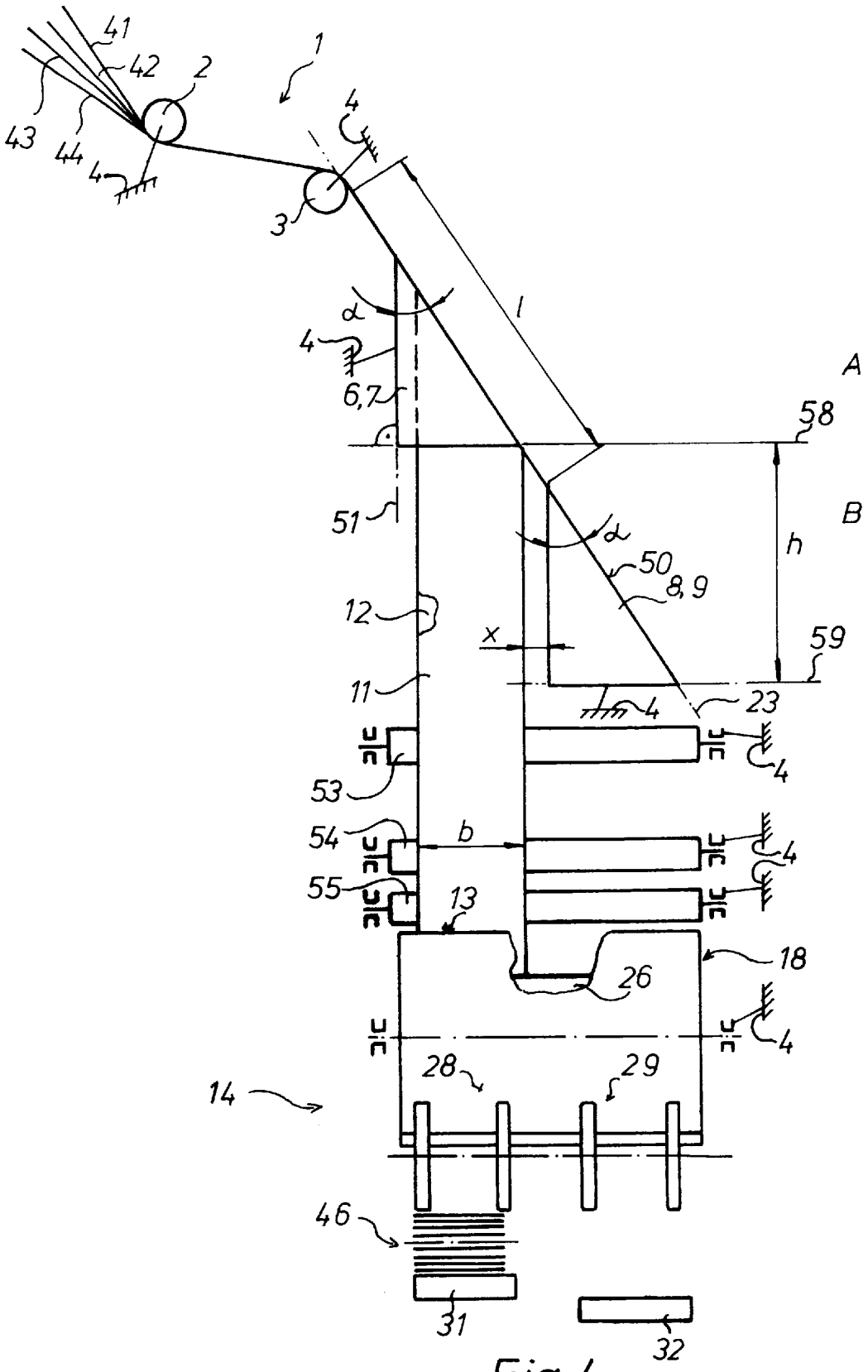
FIG. 4, an arrangement as in FIG. 2, but with paper trains entering only the first inlet of the transverse folding device.

The two positions A, B of the movable longitudinal formers mentioned can be reached, for example, in that the formers 8, 9 are displaceably arranged by an amount, for example horizontally in the axial direction b+x of the transverse folding device 14 and by an amount h in the vertical direction all as seen in FIGS. 2 and 4, for example. The amount b corresponds to the width of a paper train 11, 12, and the amount x corresponds to a safety distance between the paper trains 11, 12, 33, 34. The amount h also corresponds to a pivot height of the former holder 16, 17, or respectively of the formers 8, 9, and is calculated from the quotient of b+x in relation to the tangent of the angle alpha. The angle alpha is located between a vertical line 51 and the level of inclination of the paper running surface 50 of each one of the longitudinal formers 6 to 9. The above mentioned movement of the former holders 16, 17 can take place, for example, by means of known linear drives, chain hoists or the like, or also by means of known lever arrangements, for example rockers or rockers levers 5, 10 which are pivotable, for example, around pivot pins 15, 20 fixed in place on the paper guide frame, as shown in FIGS. 7 and 8. Thus, the right longitudinal formers 8, 9 are moved out of the position in accordance with FIG. 5 into the position in accordance with FIG. 1, and vice versa. A parallelogram-like pivot square is formed by this assembly of levers wherein, besides the two levers 5, 10 of equal length, the former holder 17 and the paper guide frame 4 also act as levers of respectively the same length. The levers 5, 10 are respectively hinged on both sides on each former holder 16, 17, for example by means of pivot pins 35, 40 as seen in FIGS. 7 and 8. An inclination of a former can be changed by means of a displacement spindle via a handwheel 30, also as seen in FIGS. 7 and 8. In the lower position B (FIG. 7), the former holders 16, 17 can be placed on abutments 91 and 92, fixed in place on the paper holder, and locked. Locking can take place for example by means of a pneumatic clamping device or by means of known rocker clamping levers.

In the upper position A (FIG. 8), the former holders 16, 17 can, for example, be placed on abutments 48, 49, which are arranged in the paper guide frame 4 to be displaceable in an axis-parallel direction in respect to the former inlet roller 3, and are fixed in place in the previously described manner. In their lower position B (FIGS. 1 and 7), the right longitudinal formers 8, 9 can respectively have an additional, and therefore positionable, paper guide element 21, 22 above the second inlet 18 of the transverse folding device 14 between the former inlet roller 3 and the upper former edge 19 of each of the right formers 8, 9. The paper guide element 21, 22 can be embodied in the form of a sheet metal guide plate or in the form of several tubes extending at a distance from each other. Blown air can be applied to the sheet metal plate, or respectively to the tubes, for the purpose of improved sliding ability. The paper guide element 21, 22 can either be attachable, or respectively detachable on the paper guide frame 4, or it can be arranged to be flipped away when not in use. Each paper guide element 21, 22 extends in the same level of inclination 23 of the downstream connected second longitudinal formers 8, 9. The level of inclination 23 of the second longitudinal formers 8, 9 in relation to a vertical line 51 simultaneously corresponds to a level of inclination 52 extending through the pivot pins 15, 20 and arranged at an angle alpha in respect to the vertical line 51 (FIG. 7). A length 1 of each paper guide element 21, 22 corresponds at least to a width b of a paper train 11, 12, and has such dimensions, that the paper train 11, 12, or respectively 33, 34 can be guided on the second inlet 18 of the double-width transverse folding device 14.

The double-width transverse folding device 14 located below the longitudinal formers 6 to 9 consists of a cutting cylinder 24, which works against cutting grooves of a cutting groove, spur and folding blade cylinder 26. The cylinder 26 in turn cooperates with a folding jaw cylinder 27. Two paddle wheels 28, 29, arranged next to each other in the axial direction, are located underneath the folding jaw cylinder 27, and deposit the folded products created by the folding apparatus on a belt delivery device 31, 32.

The following operational positions are represented in the exemplary embodiments: in a first exemplary embodiment, two paper webs 36, 37 of 1/1 width, entering one above the other, are respectively longitudinally cut by means of known longitudinal cutting devices into paper webs of 1/4 width, and are folded into longitudinally folded paper trains 11, 12, 33, 34 by means of the left and right longitudinal formers 6, 7, 8, 9 and are fed to the first and second inlet 13, 18 of the transverse folding device 14. In the process, the paper trains 11, 12, 33, 34 are guided over transfer rollers 53 and 54, or respectively 53 and 55, which are seated fixed in place on the frame, and through a drawing roller pair 57. The second or right longitudinal formers 8, 9 are provided with the paper guide elements 21, 22. A folded product 38, 39 with 32 pages from the double production of the transverse folding device has been placed on each belt delivery device 31, 32. However, it is also possible to run 64 pages in simple production.

Figure 3:
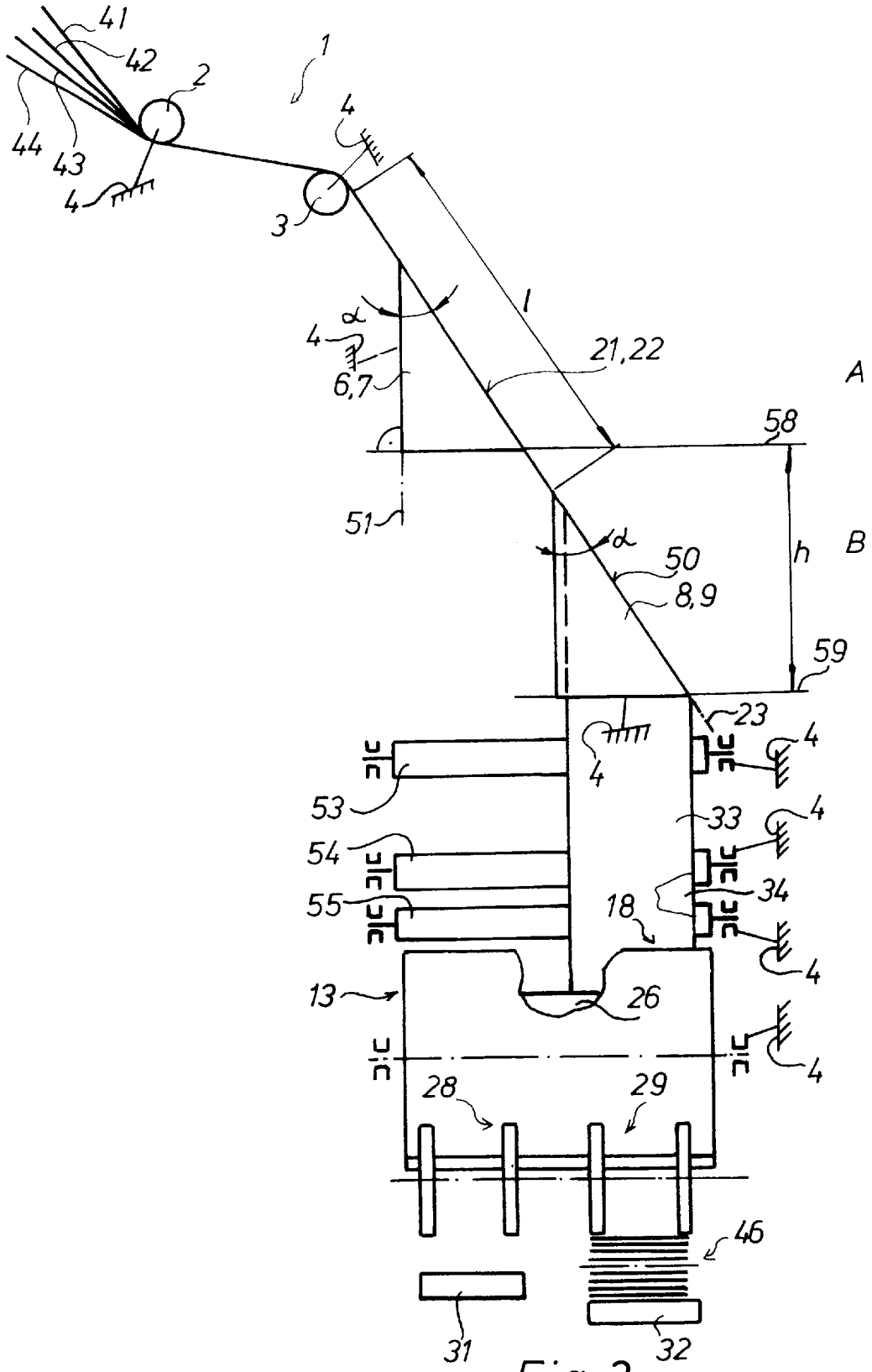
FIG. 3, an arrangement similar to the one shown in FIG. 2, but with paper trains entering only the second inlet of the transverse folding device.

Following their second longitudinal cutting, four paper webs 41 to 44 of 1/2 width entering one above the other via the right longitudinal former 8, 9 are by means of known longitudinal cutting devices of respectively the right longitudinal formers 8, 9 cut into longitudinally folded paper trains 33, 34 and are fed to the second inlet 18 of the transverse folding device 1 in a second exemplary embodiment as shown in FIG. 3. In this case, the right longitudinal formers 8, 9 are provided with the paper guide elements 21, 22. A folded product 46 of 64 pages has been created on the second belt delivery device 32 from eight paper webs of 1/4 width. The paper train 33, 34 entering the second inlet 18 of the transverse folding device 14 now has twice the thickness of the paper trains 33, 34 represented in FIG. 2.

Furthermore, in a third exemplary embodiment, as seen in FIG. 4, after again being cut longitudinally, four paper webs 41 to 44 of 1/2 width, arranged one on top of the other, enter the left longitudinal formers 6, 7. Subsequently, paper trains 11, 12 are formed, which enter into the first inlet 13 of the transverse folding device 14. A folded product 46 is created in the transverse folding device 14 and is placed on the belt delivery device 31, the same as shown in the previous exemplary embodiment as shown in FIG. 3.

Finally, in a fourth exemplary embodiment, as seen in FIGS. 5 and 6, two paper webs 36, 37 of 1/1 width entering one above the other are longitudinally cut into respective paper webs of 1/4 width, and are folded by means of the left and right longitudinal formers 6 to 9 into longitudinally folded paper trains 11, 12, 33, 34, without the paper guide elements 21, 22 being positioned before the right longitudinal formers 8 and 9. Following the entry of the paper trains 11, 12, 33, 34 into the first inlet 13 of the transverse folding device 14, a folded product 47, which consists of eight layers of 16 pages each from simple production, is therefore placed on the belt delivery device 31 again as seen in FIGS. 5 and 6.

The number of the left and right formers 6, 7, 8, 9 can be varied in accordance with the production requirements. Thus, the ratio of the left to the right longitudinal formers can also be three to three, one to three, three to one, two to four, etc. Additionally, all longitudinal formers 6 to 9 represented can also be provided with former holders 16, 17 and paper guide elements 21, 22. However, it is also possible to omit the above mentioned paper guide elements 21, 22 in the right longitudinal formers 8, 9 which are in a lower position B, and to operate without paper guide elements.

Finally, as shown in FIGS, 9 and 10, it is also possible to employ a triple-width transverse folding device 61, which respectively consists of a triple-width cutting cylinder 62, a cutting groove, spur and folding blade cylinder 63 and a folding jaw cylinder 64. Paddle wheels 66 and belt delivery devices 67 of corresponding width are arranged under the folding jaw cylinder 64. Transfer rollers 68, 69, 71 also have three times the width of a paper web of ¼ width, or they are respectively repeatedly seated next to each other corresponding to a paper web of ¼ width.

Two left longitudinal formers 73, 74 and two right ones 76, 77, i.e. a left 73, a left center 74, a right center 76 and a right 77 longitudinal former are arranged above the transverse folding device 61. In this case the left longitudinal former 73 and the right center longitudinal former 76 are in an upper position C on a first level 79. The left center longitudinal former 74 is located on a second level 80 in a center position D and is seated, for example pivotable by the amount of a height h, by means of the previously described former holder 17, not represented (see FIGS. 7 and 8), in the paper guide frame 4. In this way the center left longitudinal former 74 can be moved down into a lower position E on a third level 81.

Finally, the right longitudinal former 77 is in the lower position E, and can also be pivoted into the center position D.

It is of course also possible to embody the longitudinal formers 73, 76, which are in the upper position C, pivotably, so that they can be brought into the center position D.

Figure 10:
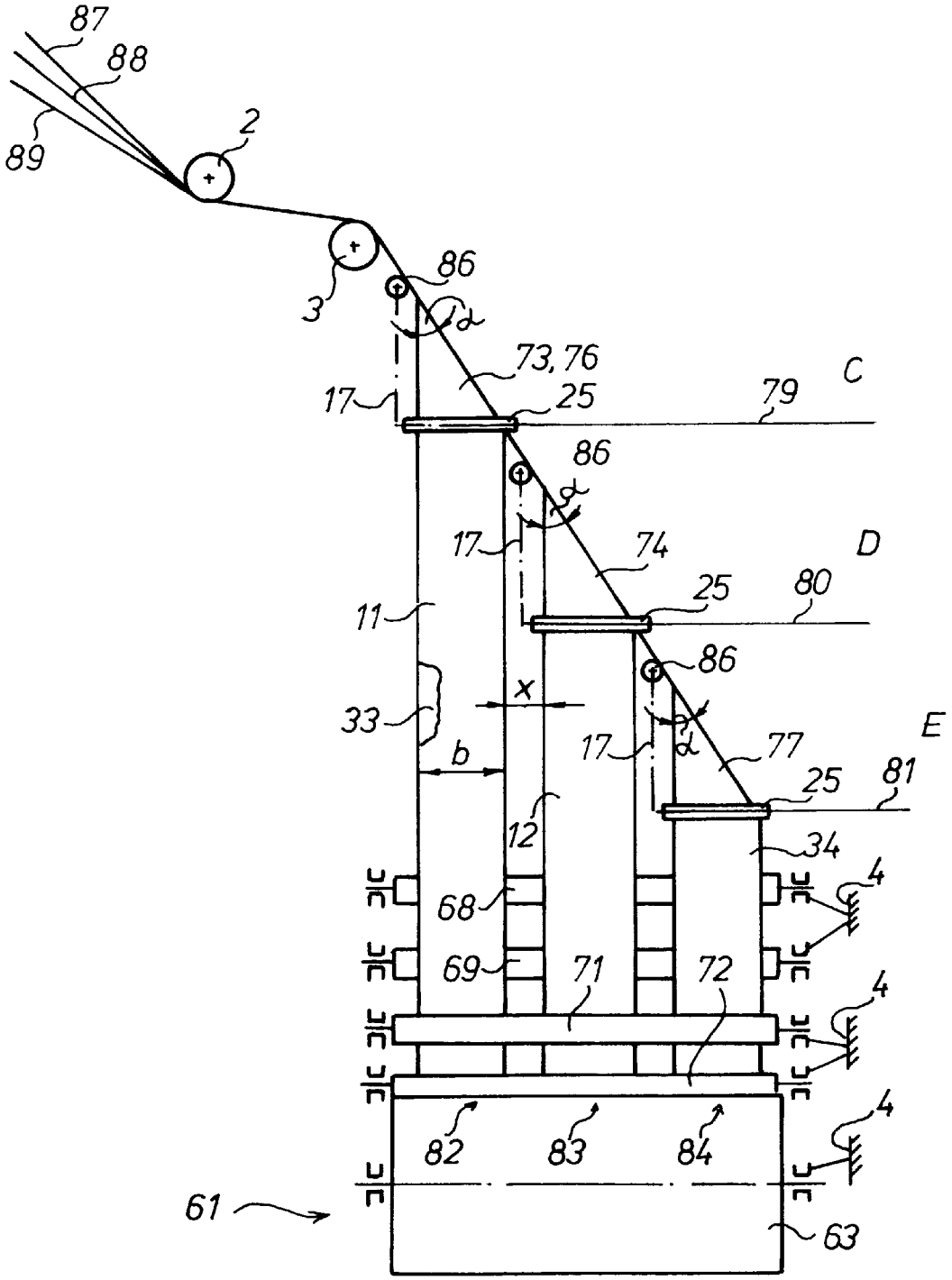
FIG. 10, a section taken along line X—X in accordance with FIG. 9, but with a representation of the paper webs above the longitudinal formers, wherein paper trains enter the three inlets of the transverse folding device.

The longitudinal formers 73 and 76 arranged in the upper position C are located above a first inlet 82 as seen in FIG. 10. The longitudinal former 74 arranged in the center position D is located above a second inlet 83, and the longitudinal former 77 arranged in the lower position E is located above a third inlet 84 of the triple-width transverse folding device 61.

Each longitudinal former 73, 74 and 76, 77 has a pair of forming rollers 25 as well as a non-driven guide roller 86 as a support roller, which are respectively seated in the former holder 17.

In a fifth exemplary embodiment, as seen in FIG. 10, after their longitudinal separation into paper webs of ¼ width, three paper webs 87, 88, 89 of ⅓ width arranged one on top of the other, run into the longitudinal formers 73, 74, 76, 77, and leave it, respectively longitudinally folded, as paper trains 11, 12, 33, 34. The longitudinal formers 73, 76, which are in the upper position C (FIGS. 9 and 10), conduct the paper trains 11, 33 over the transfer rollers 68, 71 to the first inlet 82 of the transverse folding device 61 as seen in FIG. 10. In the course of producing telephone directories, for example, a product of 48 pages is formed with uncollected production, and a product of 96 pages with collected production, which is placed on the belt delivery device 67 via the paddle wheel 66.

The longitudinal former 74 in the center position D conducts the paper train 12 over the transfer rollers 68, 69, 71 to the second inlet 83 of the transverse folding device 61. In the course of producing telephone directories, for example, a product of 24 pages is formed with uncollected production, and a product of 48 pages with collected production and is conducted to the belt delivery device 67.

The longitudinal former 77 in the position E conducts the paper train 34 to the third inlet 84 of the transverse folding device 61, and a product is created which corresponds to the product formed from the paper train 12.

With a changed position of the longitudinal formers 73, 74, 76, 77 it is of course also possible to conduct the paper trains 11 and 33 to the first inlet 82, and the paper trains 12 and 34 to the second inlet 83 or the third inlet 84. It is furthermore possible to assign all paper trains 11, 12, 33, 34 to the second inlet 83 of the transverse folding device 61, etc.

Figure 9:
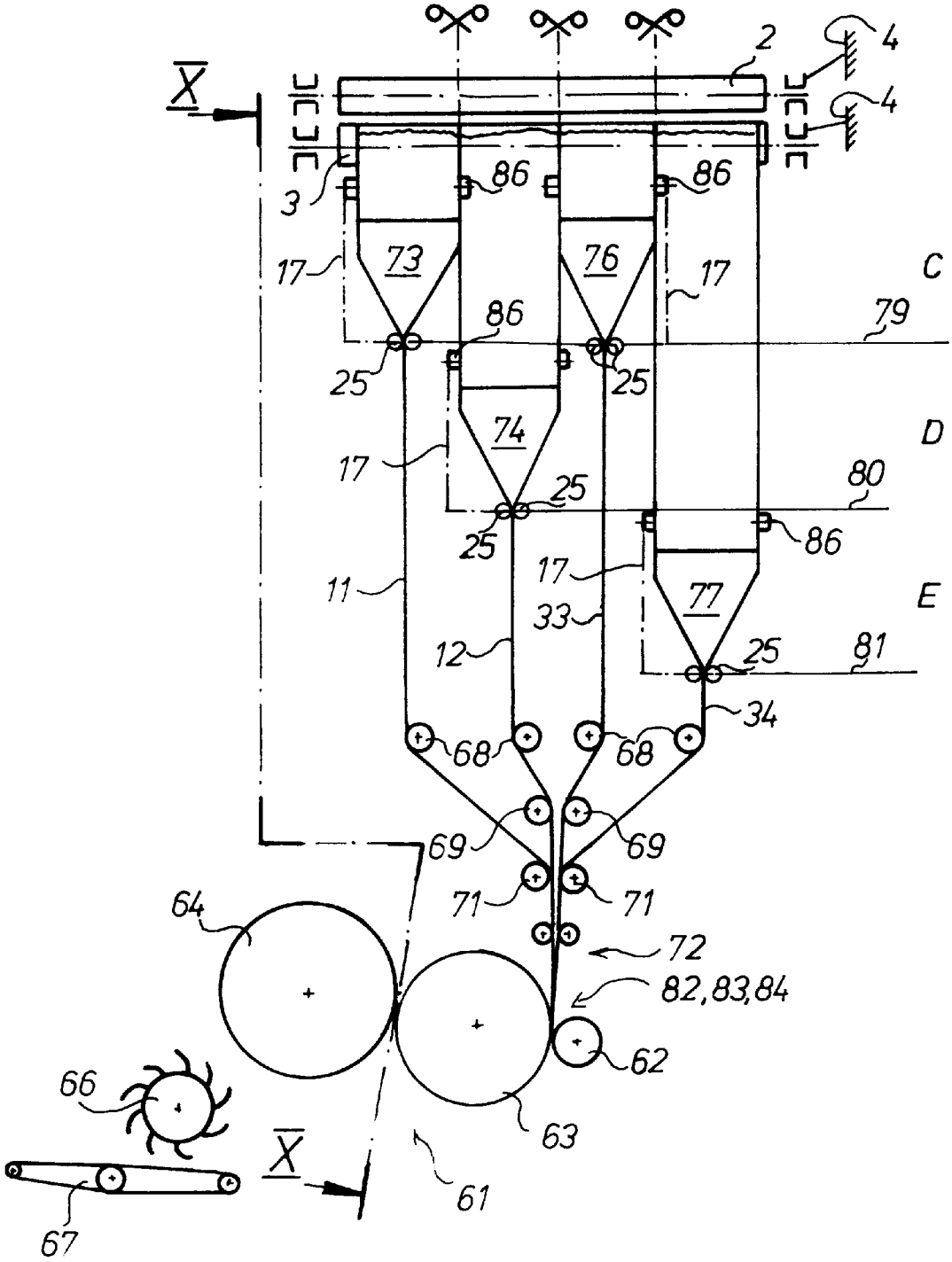
FIG. 9, a schematic view of a triple-width transverse folding device with left and right longitudinal formers arranged above it in accordance with the invention on three different levels.

In connection with a triple-width transverse folding device such as the one shown in FIGS. 9 and 10, it is also possible to arrange a paper guide element 21, 22, not specifically represented in FIGS. 9 and 10, in the previously described manner between the former inlet roller 3 and the upper edge 19 of the former as shown in FIGS. 7, 8 of a longitudinal former which is in a center position D or a lower position E.

In summary, the nature of the present invention consists in that at least the longitudinal formers 8, 9, 74, 77 can be moved in a vertical direction by means of parallelogram-like pivot squares 4, 15, 5, 35, 17 or 16, or 4, 20, 10, 40, 17 or 16. In this case the above mentioned pivot squares have at least two rockers or rocker levers 5, 10, which can be pivoted parallel with each other and which are of the same length. At their first ends 45, 56, the rockers 5, 10 are directly or indirectly pivotable on the machine frame 4, i.e. they are hinged on pivot pins 15, 20. Second ends 65, 70 of the rockers 5, 10 are directly or indirectly pivotable on the longitudinal formers 8, 9, 74, 77, i.e. they are hinged by means of pivot pins 35, 40.

In accordance with a second embodiment variant, the longitudinal formers 8, 9, 74, 77 are additionally arranged horizontally displaceable in the direction of the axis of rotation of the forming rollers 25, for example on a carriage that is horizontally displaceable.

In accordance with another embodiment variant, the horizontal displacement of the longitudinal formers 8, 9, 74, 77 can also take place in that the rockers 5, 10 are embodied to be adjustable, i.e. they can be directedly shortened.

While preferred embodiments of a device for producing folded items in accordance with the present invention have been set forth fully and completely hereinabove, it will be apparent to one of skill in the art that various charges in, for example, the type of printing press unit, the overall drive assembly for the press, the type of web or webs being printed, and the like could be made without departing from the true spirit and scope of the present invention which is accordingly to be limited only by the following claims.

What is claimed is:

1. A removable longitudinal former for forming a paper web into a plurality of paper trains, said movable longitudinal former being supported for horizontal movement in a direction along an axis of rotation of a multi-width transverse folder which receives said plurality of paper trains from said movable longitudinal former, said movable longitudinal former also being movable generally vertically, said movable longitudinal former being supported for both said horizontal and said vertical movement by a parallelogram pivot-square linkage, said horizontal movement being at least as great as a width of one of said plurality of paper trains.

2. The movable longitudinal former of claim 1 wherein said parallelogram pivot-square linkage includes at least first and second rockers, each of which has a first end and a second end, said first and second rockers being of the same length and being parallel to each other, said first end of each of said first and second rockers being pivotally connected to a machine frame and said second end of each of said first and second rockers being pivotally connected to said movable longitudinal former.

3. The movable longitudinal former of claim 1 wherein said movable longitudinal former is associated with a former roller having an axis of rotation and further including means to displace said movable longitudinal former in the direction of said axis of rotation of said former roller.

4. A movable longitudinal former supported for movement along an axis of rotation of a transverse folder, said movable longitudinal former being movable generally vertically and being supported by a parallelogram pivot-square linkage, said parallelogram pivot-square linkage including at least first and second rockers, each of which has a first end and a second end, said first end of each of said first and second rockers being pivotally connected to a machine frame and said second end of each of said first and second rockers being pivotally connected to said movable longitudinal former.

5. The movable longitudinal former of claim 4 wherein said first and second rockers are of the same length and are parallel to each other.

* * * * *